US006185905B1

(12) United States Patent
Neri

(10) Patent No.: US 6,185,905 B1
(45) Date of Patent: Feb. 13, 2001

(54) DEVICE AND A METHOD FOR THE FORMATION AND STRAPPING OR BANDING OF GROUP OF SHEETS, IN PARTICULAR BANKNOTES

(75) Inventor: Armando Neri, Bologna (IT)

(73) Assignees: G. D. S.p.A., Bologna (IT); Currency Systems International Inc., Irving, TX (US)

( * ) Notice: Under 35 U.S.C. 154(b), the term of this patent shall be extended for 0 days.

(21) Appl. No.: 09/320,727

(22) Filed: May 27, 1999

(30) Foreign Application Priority Data

Jun. 1, 1998 (IT) ..... BO98A0343

(51) Int. Cl.[7] ..... B65B 13/08

(52) U.S. Cl. ..... 53/399; 53/447; 53/540; 53/589

(58) Field of Search ..... 53/540, 531, 399, 53/447, 582, 586, 529

(56) References Cited

U.S. PATENT DOCUMENTS 4,374,463 * 2/1983 Omura et al. ..... 53/589 X
4,492,072 * 1/1985 Miyano et al. ..... 53/586
4,531,344 * 7/1985 Sato et al. ..... 53/589 X
5,996,314 * 12/1999 Pennini et al. ..... 53/589 X

FOREIGN PATENT DOCUMENTS 0 420 560 4/1991 (EP) .
0 811 956 12/1997 (EP) .
2 138 789 10/1984 (GB) .

* cited by examiner

*Primary Examiner*—Linda Johnson
(74) *Attorney, Agent, or Firm*—Pillsbury Madison & Sutro LLP

(57) ABSTRACT

Banknotes emerging from a currency processing machine with a plurality of formation channels advance in succession along respective ducts of which the runouts are equipped with respective rollers positioned to pick up the notes, transfer them to each channel and stack them on a first shelf. An occluding mechanism operating at the inlet of each channel causes groups of the notes to accumulate on the corresponding first shelf, each of which is picked up by a first gripper and transported toward a first strapping/banding station where a gripping mechanism takes up a continuous strip of banding material by the leading end and passes it around each successive group; the strip is cut into discrete lengths by a tool designed also to seal the leading end to the trailing end of the cut length, banding the group to fashion a bundle which is then transferred to a second shelf and carried by this same shelf toward the outlet of the channel.

23 Claims, 5 Drawing Sheets a
b
c
d
e
f
g
h
i
j

DEVICE AND A METHOD FOR THE FORMATION AND STRAPPING OR BANDING OF GROUP OF SHEETS, IN PARTICULAR BANKNOTES

BACKGROUND OF THE INVENTION

The present invention relates to a device for forming and strapping or banding groups of sheets, banknotes in particular.

The invention finds application to advantage in machines by which banknotes are ordered and wrapped in bundles; indeed reference is made directly to this same art field in the following specification, albeit with no limitation in scope implied.

The fitness of banknotes for continued use can be verified utilizing machines, embraced by the prior art, comprising a plurality of stacking modules with respective formation channels. Banknotes of whatever type are fed singly and in succession into the modules, examined and rejected if defective, then sorted according to denomination and/or type and directed separately toward respective outlets afforded by the channels. In this way, stacks of single banknotes are formed at each of the outlets.

As the single notes are accumulated and grouped in predetermined numbers, each stack is collected from the outlet of the relative channel by a pickup and transfer device and distanced from the channel. The pickup and transfer device is capable typically of movement along a predetermined path extending along the machine and able thus to address each one of the channels whenever a group of banknotes has formed at the relative outlet, so that the notes can be taken up and transferred to a strapping or banding station.

On arrival at the station in question, the group of notes is released to a pickup device operating in conjunction with a strapper/bander device by which at least one wrapping band is fastened around the group to produce a respective bundle.

Whilst the machines in question lack nothing in terms of the effectiveness and precision with which the operation of strapping or banding the groups of banknotes is carried out, they betray the drawback that each group of banknotes accumulated has to be transferred in turn from the respective formation channel to the strapping/banding station, which in most machines will occupy a position remote from the stacking module.

This means that the pickup and transfer devices must be capable of high operating speeds in order to match the rapid rates at which the groups of notes are formed cyclically along the respective channels making up the machine.

Accordingly, the devices in question need to be equipped with efficient and reliable means by which to pick up and retain the stacks of banknotes in order to ensure a correct transfer with no tendency of the stack to break up, also with sophisticated tracking systems able to ensure high positioning accuracy, which is often difficult to obtain given the high operating speeds demanded. The effect of such requirements is obviously to incur additional costs impacting significantly on the cost of the machine overall.

The problem is especially evident when used notes are being processed, by reason of the difficulty in handling and compacting such notes when stacked.

Notwithstanding the constraints imposed by the fact that the groups of notes must be transferred without breaking up, and the need for a high level of accuracy in positioning, it has been possible in practice to obtain high operating speeds from the pickup transfer devices, albeit such speeds always remain low in relation to the rates at which the notes are stacked into groups along the formation channels, and in consequence the production cycle of the machine overall continues to be slowed down; thus, there is no material advantage ultimately in the fact that notes can be processed and stacked efficiently and swiftly by such machines.

The object of the present invention is to provide a device for the formation and strapping or banding of groups of banknotes such as will increase the productivity of the currency processing machines in question, simplifying and speeding up the step of picking up the bundles and overcoming the drawbacks described above.

SUMMARY OF THE INVENTION

The stated object is realized in a device for the formation and strapping or banding of groups of sheets, in particular banknotes advancing along a feed duct at the outfeed of a processing machine comprising a plurality of stacking modules, each equipped with a formation channel extending along a respective stacking axis, presenting an inlet and an outlet and communicating with the feed duct via a roller by which single notes are taken up and transferred to the inlet of the relative channel, wherein the channel accommodates at least a first receiving element on which the notes are deposited one on top of another.

The device in question comprises a pickup and strapper/bander unit at the inlet of each formation channel, positioned and embodied so as to operate in conjunction with the first receiving element in ordering and separating the notes into distinct groups, such as will take up each single group of notes cyclically, apply at least one wrapping band to obtain a single bundle and position each bundle along the stacking axis of the formation channel.

The present invention relates also to a method of forming and strapping or banding groups of sheets, in particular banknotes advancing along a feed duct at the outfeed of a processing machine comprising a plurality of stacking modules, each equipped with a formation channel presenting an inlet and an outlet and extending along a respective stacking axis.

The method disclosed includes the steps of taking up the single notes from the feed duct by means of a roller, transferring them to the inlet of the relative formation channel and depositing them one on top of another on at least a first receiving element occupying the inlet of the channel, and comprises the additional steps of ordering and separating the notes into distinct groups at the inlet of each formation channel, taking up each group of notes cyclically at the inlet of the channel by means of a pickup and strapper/bander unit operating in conjunction with the first receiving element, applying at least one wrapping band to each group to obtain single bundles, and positioning each bundle along the stacking axis of the formation channel.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
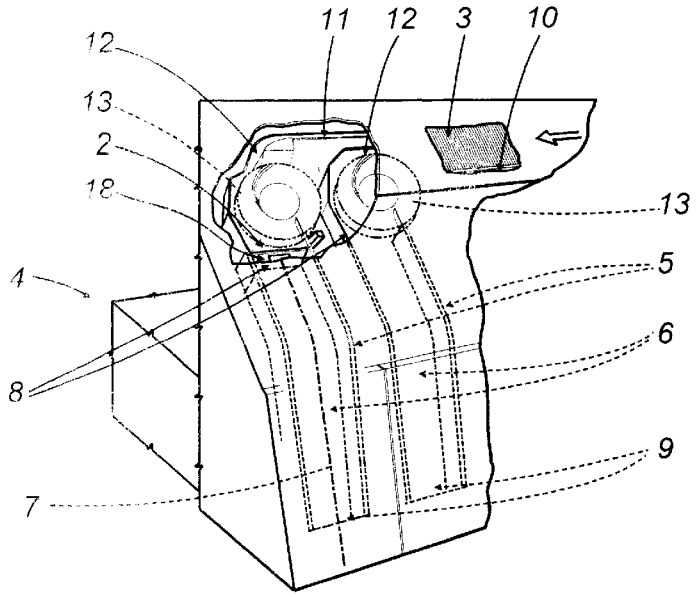
FIG. 1 shows a machine for processing banknotes, illustrated in perspective and with certain parts omitted for clarity, equipped with a plurality of stacking modules and, associated with each module, a device for forming and strapping/banding groups of notes embodied in accordance with the present invention.

In FIGS. 2–6 of the drawings, 1 denotes a device, in its entirety, by which groups 2 of banknotes 3 are formed and strapped or banded; the device 1 is installed on the outfeed of a machine 4, indicated schematically and only in part in FIG. 1, by which the notes 3 are inspected singly and discarded if defective or damaged.

The machine 4 comprises a plurality of stacking modules 5 (two such modules only are illustrated in FIG. 1), each of which is served by a corresponding device 1 of the type disclosed. In particular, each module 5 is equipped with a respective formation channel 6 extending along a stacking axis denoted 7 and affording an inlet 8 and outlet 9.

Internally of the machine 4, the notes 3 are made to advance along a main common feed duct 10 which divides ultimately to form as many secondary feed ducts 11 as there are stacking modules 5, and on reaching the runout 12 of each secondary duct 11, taken up individually by respective rollers 13 of familiar embodiment serving each of the modules 5 and positioned near to the runout 12 of the single duct 11 in such a way as to connect the relative formation channel 6 with the main duct 10.

The rollers 13 rotate about respective axes 13*a* in a counterclockwise direction denoted F1 (FIG. 2); each roller incorporates a hub 14, and extending radially from the hub, a plurality of lamellar elements 15 embodied in a flexible and resilient material each designed to take up notes 3 singly and in succession, in conventional manner, and transfer them to the inlet 8 of the corresponding formation channel 6 where a strategically located fixed arm 16 intercepts each note 3 at the leading edge 3*a* and causes it to separate from the lamellar element 15 as the roller 13 rotates.

Once released from the roller 13, the notes 3 are caused to lie flat, transversely to the stacking axis 7, and drop one on top of another toward the inlet 8 of the formation channel 6 where they are ordered and aligned by a compactor 17 of familiar embodiment, located on the side of the channel 6 remote from the fixed arm 16, then directed beyond the mouth 8*a* of the inlet 8 and into contact with a first receiving element or shelf 18, settling one by one and accumulating in predetermined number to form a group 2.

The device 1 illustrated in FIGS. 2 to 6 comprises a pickup and strapper/bander unit 19, placed at the inlet 8 of the corresponding formation channel 6, which in turn comprises an occluding element 20 embodied as a flexible rolling shutter 21 slidable along a pair of lateral tracks 22 extending along one flank 23 of the formation channel 6 and fully across the mouth 8*a* of the inlet 8. The shutter 21 is rendered capable of movement, through the agency of a conventional actuator 24 shown fragmentarily in FIGS. 2 to 6, between a non-operating position (see FIG. 2) in which the mouth 8*a* of the inlet 8 afforded by the channel 6 remains open, allowing the notes 3 to pass through and settle on the first shelf 18, and an operating position (FIGS. 3 to 6) in which the mouth 8*a* of the inlet 8 is occluded by the shutter 21. When in the operating position, the shutter 21 effectively occupies the mouth 8*a* of the inlet 8, affording a platform 25 on which notes 3 coming off the roller 13 are caused to accumulate in a controlled manner, their passage toward the first shelf 18 being interrupted momentarily and reinstatably so as to bring about the formation, on the shelf 18, of a single group 2 consisting in a predetermined number of notes 3.

The unit 19 in question comprises first means 26 positioned alongside the first shelf 18, consisting in a first gripper 27 and a first strapper/bander assembly 28, of which the function is to pick up, transfer and release a group 2 of banknotes 3. The first assembly 28 in turn comprises first means 29 designed to feed a strip 30 of strapping/banding material, consisting in a pair of pinch rolls 43 by which the continuous strip 30 is advanced along a predetermined path P, through a supporting guide 31 toward a first strapping/banding station 32.

Figure 5:
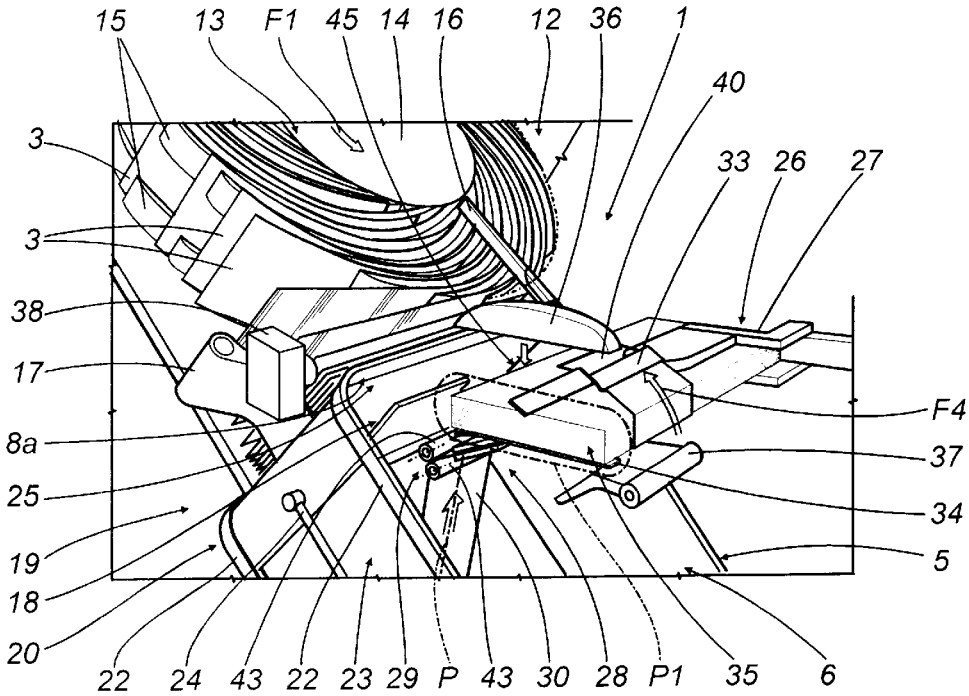
Figure 6:
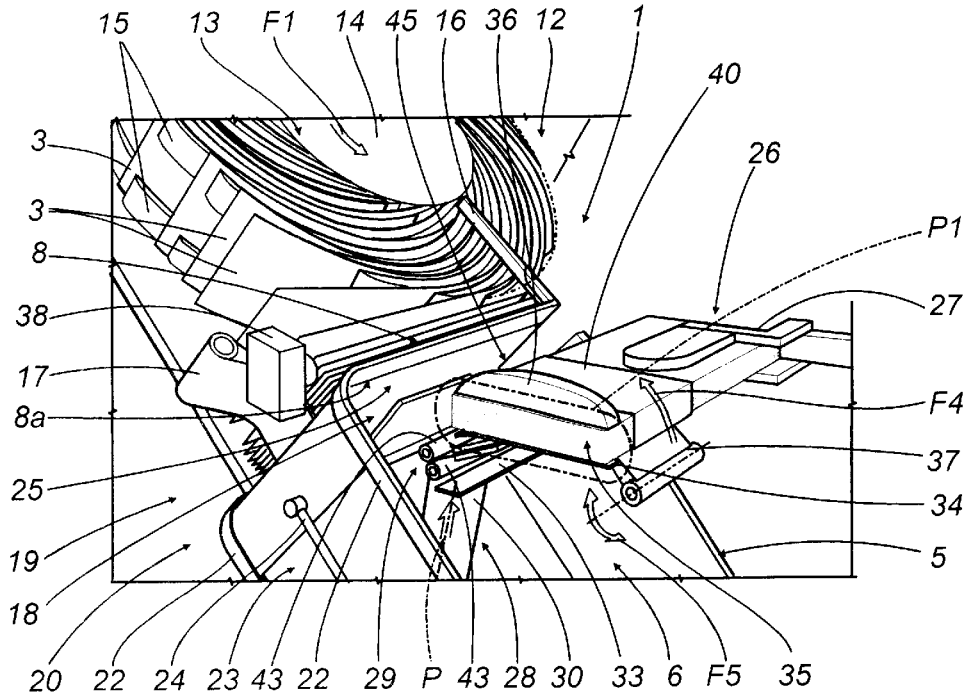

The first strapping/banding station is equipped with a first gripping element 33 of conventional type, capable of movement along a looped path P1 illustrated in FIGS. 5 and 6, which is designed to seize the leading end 30*a* of the strip 30 and pass it around a group 2 of notes 3, also a bracket 34 supporting at least one specific portion 35 of a group 2 of notes 3, and a presser arm 36 operating in conjunction both with the first gripper 27 and with the gripping element 33 holding the leading end 30*a* of the strip 30, of which the function is to compact the specific portion 35 of the group 2 of notes 3 against the bracket 34, the portion 35 in question being effectively an edge of the group remote from the edge held by the gripper 27 of the first pickup means 26.

The guide 31 also functions as a stationary anvil operating in conjunction with a movable cutting and sealing tool 37 by which the continuous strip 30 is divided into discrete bands and the leading end 30*a* sealed to the trailing end of each successive band generated by the cutting stroke.

Figure 2:
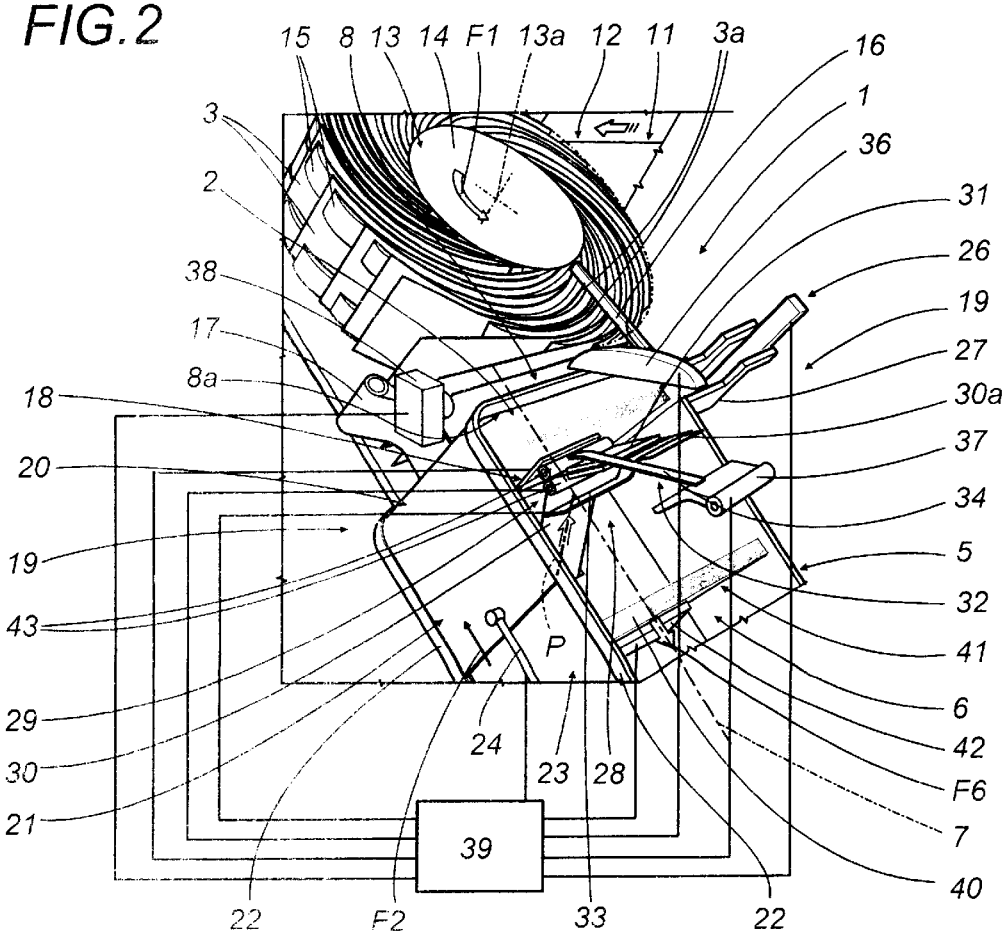
FIGS. 2 to 6 illustrate a single stacking module, seen schematically in perspective and with certain parts omitted, and associated with each module, a device for forming and strapping/banding groups of banknotes shown in a first possible embodiment and effecting a succession of operating steps.

Turning now to the operation of the device 1 as described thus far and illustrated in FIGS. 2 to 6, related to a single stacking module 5 and starting from the configuration indicated in FIG. 2 in which the shutter 21 occupies the non-operating position and the mouth 8*a* at the inlet 8 of the formation channel 6 is left open, the notes 3 carried by the roller 13 are released flat and allowed to drop one after the other toward the inlet 8 of the relative channel 6. Before passing beyond the mouth 8*a* of the inlet 8, the notes 3 are compressed and aligned by the compactor 17 so that on arrival at the first shelf 18 they will be correctly and neatly ordered one on top of another.

The single notes 3 passing through the inlet 8 of the channel 6 are counted off by a sensor 38 wired to a control unit 39 (FIG. 2); once the notes have accumulated to a predetermined number, an output signal produced by the sensor 38 is relayed by the control unit 39 to the actuator 24, which proceeds to advance the shutter 21 along the tracks 22 in the direction denoted F2 toward the position in is which the mouth 8*a* at the inlet 8 of the channel 6 is occluded.

As soon as movement is generated in the occluding direction F2, the free edge 45 of the shutter 21 (indicated in FIGS. 3 to 6) immediately intercepts the succession of notes 3 coming off the roller 13, and thus occasions a momentary interruption in the timing of their passage through the mouth 8*a* to the inlet 8 of the channel 6, hence the timing of their descent onto the first shelf 18. On completion of the occluding movement, the shutter 21 establishes a platform 25 across the mouth 8*a* of the inlet 8 on which the notes 3 will accumulate momentarily.

Thus, a single group 2 comprising a predetermined number of banknotes 3 is formed separately on the first shelf 18.

During the formation of the group 2, the first shelf 18 will translate along the stacking axis 7 of the channel 6 from a raised position occupying substantially the same plane as the mouth 8*a* of the inlet 8, in which it begins to receive the notes 3, toward a lowered position at which it pauses in readiness for the first gripper 27 to take up the completed group 2.

Figure 3:
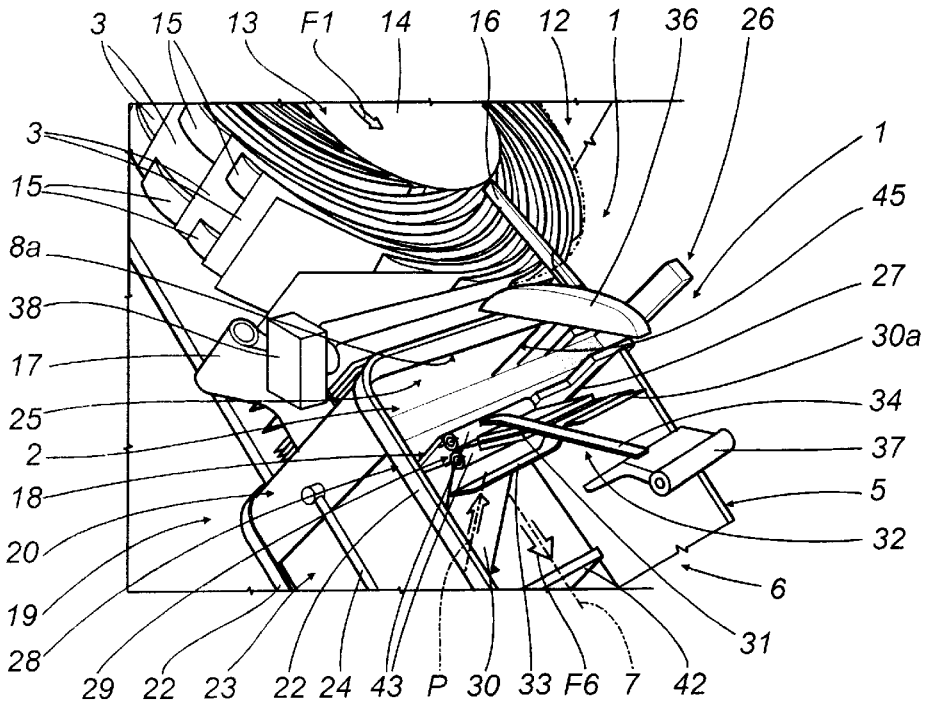
Figure 4:
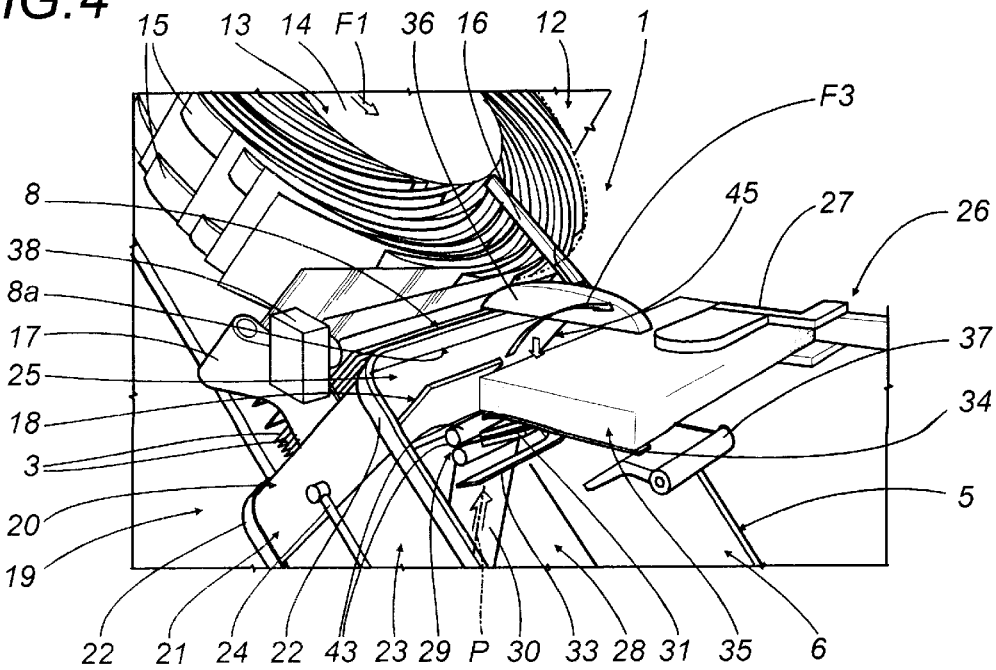

As illustrated in FIG. 3, when the first shelf 18 reaches the lowered position, the first gripper 27 assumes a first pickup position and lays hold on one edge of the group 2 of notes 3. Having picked up the group, the gripper 27 moves in the direction denoted F3 in FIG. 4 toward a second position in which the notes are transferred toward the first strapping/banding station 32, where the group 2 is held stationary in a position of readiness with one edge portion 35 resting on the bracket 34. At the same time, the strip 30 is advanced by the pinch rolls 43 along the feed path P, passing through the guide 31, and its leading end 30*a* taken up by the gripping element 33.

As indicated in FIGS. 5 and 6, the first gripping element 33 takes up the leading end of the strip 30 and moves off along the looped path P1, orbiting about the group 2 in the direction denoted F4 and describing substantially one complete circuit in such a way as to wrap the strip around the notes 3; at the same time, the presser arm 36 will descend synchronously with the movement of the gripping element 33 onto the edge portion 35 of the group 2 and compact it against the bracket 34, so that the gripping element 33 is able to tighten the strip 30 around the notes 3. Having completed its orbit, the gripping element 33 comes to a halt and awaits the action of the cutting and sealing tool 37, which duly rotates in the direction denoted F5 from the lowered position illustrated in FIG. 5 toward the raised position of FIG. 6 where it combines with the guide 31 to cut the strip 30, producing a discrete length, and at the same time to seal the leading end 30*a* to the trailing end of the cut length, thus fashioning a band 40 secured around the group 2 of notes 3 to form a bundle 41. Observing FIG. 2, once the steps of positioning, cutting and sealing the strip 30 have been completed, the first gripper 27 moves toward a third position (not illustrated) in which the bundle 41 is transferred and released to a second shelf 42 occupying the formation channel 6 at a given point beyond the pinch rolls 43 and the guide 31 and capable of movement in the direction denoted F6 along the stacking axis 7 in such a way as to accompany the newly formed bundle 41 toward the outlet 9 of the channel 6.

The first gripper 27 resumes its first position, ready to take up a further group 2 of notes 3 as illustrated in FIG. 2, the shutter 21 reopens the mouth 8*a* of the inlet 8 to the formation channel 6, and the sequence of steps described thus far will be repeated, implemented cyclically by each of the stacking modules 5 each time the relative sensor 38 confirms the accumulation of a predetermined number of single notes 3 making up one group 2.

The orbital motion of the gripping element 33 and the movements of the first gripper 27, the presser arm 36 and the cutting and sealing tool 37, also the action of the pinch rolls 43 and of the first shelf 18 and the second shelf 42, will be timed one with another by devices not shown in the drawings; such devices are familiar to a person skilled in the art, who will have no difficulty in selecting the mechanical linkages and drive means suitable for producing the sequence of movements once these have been described.

Figure 7:
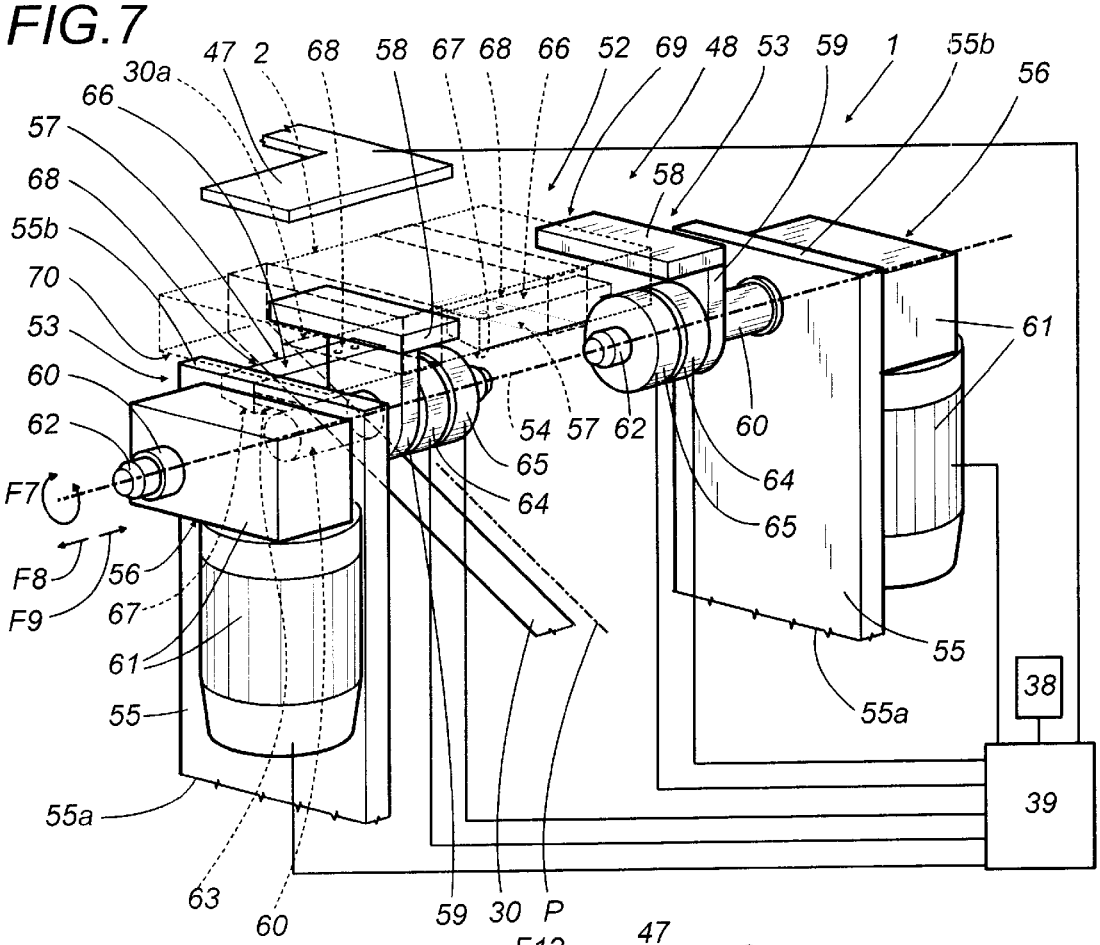
FIG. 7 and FIG. 8 illustrate a device for forming and strapping or banding groups of banknotes, seen schematically in perspective and with certain parts omitted, shown in a second possible embodiment and effecting two successive operating steps.
Figure 8:
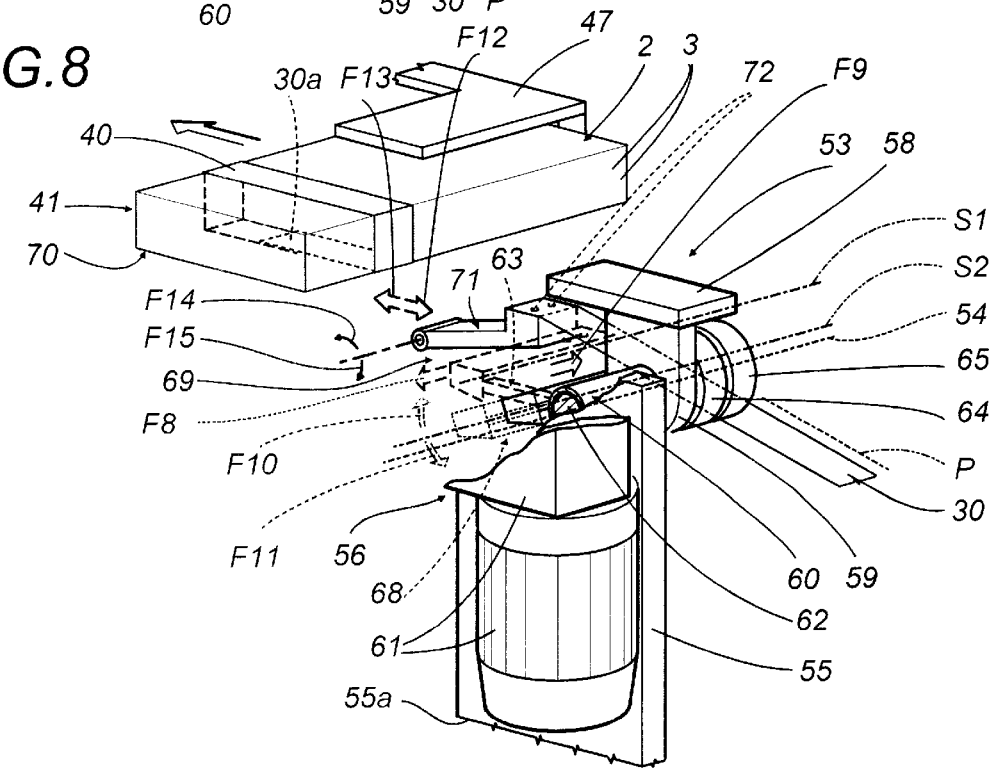
Figure 9:
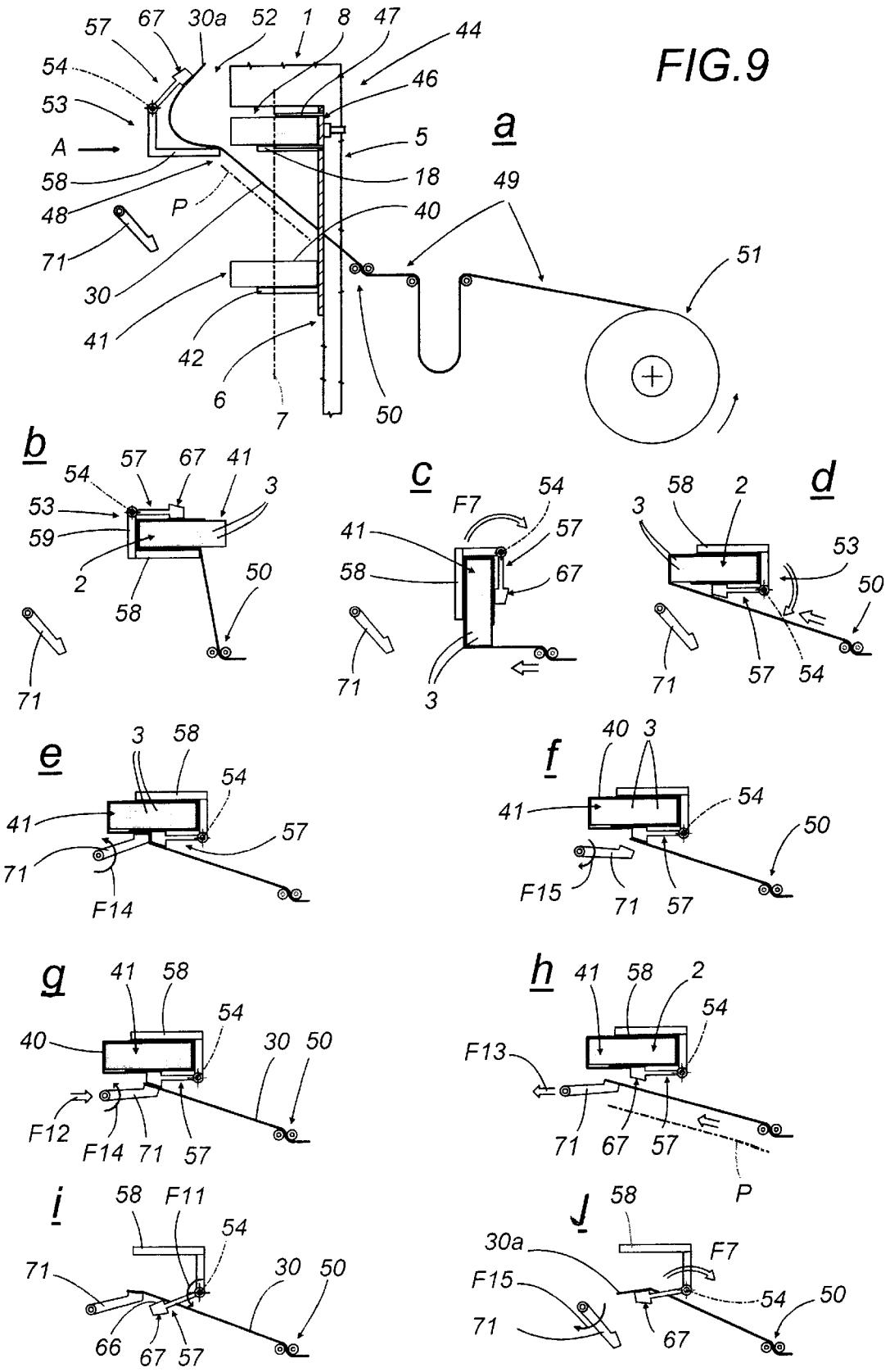
FIGS. 9*a*–9*l* is a detail of the device in FIGS. 7 and 8, viewed schematically in a side elevation and shown effecting a succession of operating steps.

In the example of FIGS. 7, 8 and 9, the occluding element 20 is the same as described with reference to FIGS. 2 to 6; accordingly, its embodiment and operation therefore require no further description.

The device 1 as illustrated in FIGS. 7, 8 and 9*a* incorporates a pickup and strapper/bander unit 44 positioned at the inlet 8 of the single channel 6, comprising second means 46 by which to pick up, transfer and release a group 2 of notes 3, composed of a second gripper 47 and a second strapper/bander assembly 48.

As discernible in FIG. 9*a*, the second assembly 48 in its turn comprises second means 49 by which to feed a continuous strip 30 of strapping/banding material, and a second strapping/banding station denoted 52. The second feed means 49 comprise a pair of freely revolving rollers 50 between which the strip 30, decoiling from a roll 51, is made to pass as it advances along a predetermined path P.

The second station 52 is equipped with a pair of mutually opposed gripper heads 53 pivotable about a common axis 54 of rotation extending transversely to the stacking axis 7. The gripper heads 53 occupy a substantially frontal position in relation to the inlet 8 of the respective formation channel 6 and are supported by respective brackets 55 connected to the channel 6 on opposite sides of the stacking axis 7.

FIG. 7 is a view from letter A in FIG. 9*a* showing the two brackets 55 fragmented at the two bottom ends 55*a*, which in effect will be connected to the channel 6.

The ends 55*b* of the brackets 55 remote from the ends connected to the channel 6 afford mountings for respective support and drive units 56 by which the associated heads 53 are caused to rotate about the common axis 54.

Each head 53 comprises mutually opposed first and second jaws 57 and 58 designed to accept and retain two opposite extremities of a group 2 of notes 3 transferred from the first shelf 18 to the heads 53 by the second gripper 47.

The second jaw 58 coincides with the free end of a first arm 59 connected rigidly to a first shaft 60 mounted concentrically with the common axis 54 of rotation, by way of a bearing not indicated in the drawings, to the respective bracket 55. The first shaft 60 is hollow, and coupled mechanically to a geared motor 61 by which it can be rotated about the common axis 54 in the direction of the arrow denoted F7, clockwise or counterclockwise.

The first shaft 60 coaxially ensheathes a second shaft 62 that is free both to rotate about and to reciprocate along the common axis 54 in relation to the first shaft 60. The first jaw 57 is associated rigidly with the second shaft 62 by way of a second arm 63, and constitutes the free end of this same second arm 63.

The second shaft 62 is coupled mechanically to a rotary actuator 64 serving to control an angular position, for example a stepping motor, associated rigidly in turn with the first arm 59 and rotatable thus as one with the first shaft 60. The function of the rotary actuator 64 is to rotate the second shaft 62 about the common axis 54 in relation to the first shaft 60 in such a manner as to move the first jaw 57 toward and away from the second jaw 58 in the directions denoted F10 and F11 respectively, thereby determining the mutual positions of the two jaws 57 and 58.

Also coupled mechanically to the second shaft 62 is a linear actuator 65, such as an electromagnet, rigidly associated likewise with the first arm 59 and therefore with the first shaft 60. The function of the linear actuator 65 is to shift the second shaft 62 along the common axis 54 relative to the first shaft 60 in opposing directions, as indicated by the arrows denoted F8 and F9 in FIG. 7.

With the second shaft 62 rendered thus capable of linear movement along the axis 54 of rotation, the first jaw 57 can be directed not only toward and away from the second jaw 58, but also along a first offset path S1 extending substantially parallel to the axis 54, caused to move in a first direction F8 essentially transverse to the stacking axis 7 that distances it from the gripper head 53 opposite, and along a second offset path S2 parallel to the first path S1 in a second direction F9 opposite to the first.

To allow the first jaw 57 the freedom of movement described above, the first shaft 60 will afford a slot (not illustrated) slidably accommodating the second arm 63 by which the first jaw 57 is carried.

Still in FIGS. 7, 8 and 9, each first jaw 57 will be seen to present an inner face 66 directed toward the second jaw 58, and an outer face 67 on the side remote from the inner face 66. Each inner face 66 and outer face 67 incorporates respective means 68 of conventional embodiment able to retain the leading end 30*a* of the strip 30, of which only those relative to the inner face 66 are visible in FIG. 7.

Such means 68 could consist for example in a pair of suction holes connected in conventional fashion (not illustrated) to a source of negative pressure.

Each first jaw 57 combines with the respective retaining means 68 to create second means 69 by which the leading end 30*a* of the strip 30 is picked up, retained, and held against one face 70 of the group 2 of banknotes 3.

Observing FIG. 8 and FIG. 9, the second strapper/bander assembly 48 comprises a second cutting and sealing tool denoted 71.

The second tool 71, which operates in conjunction with the first jaw 57, is designed to divide the continuous strip 30 into discrete lengths and seal the leading end 30*a* to the trailing end of the cut length, fashioning a band 40 around a group 2 of notes to form a bundle 41.

The second cutting and sealing tool 71 comprises respective means 72 by which to pick up and retain the leading end 30*a* of the strip 30, and is capable of movement between a first cutting and sealing position illustrated in FIG. 9*e* in which the tool 71 strikes against the first jaw 57, cutting through the strip 30 to generate a discrete length and at the same time sealing together the leading end 30*a* and the trailing end of the cut length to fashion a band 40 around the group 2 of notes 3, and a second position illustrated in FIG. 9*g* in which the tool 71 is offered to the outer face 67 of the first jaw 57 so as to pick up the newly cut leading end 30*a* of the strip 30 from the selfsame first jaw.

The embodiment of the second tool 71 is such that in the operating position of FIG. 9*e*, during the cutting and sealing step, the leading end 30*a* of the strip 30 can be aligned with the outer face 67 of the first jaw 57, which thereupon takes up the end 30*a* as indicated in FIG. 9*f*.

In the position of FIG. 9*h*, the second tool 71 draws the strip 30 taut along the feed path P through a given distance below the outer face 67 of the first jaw 57.

In like manner to the embodiment of FIGS. 2 to 6, the device 1 as illustrated in FIGS. 7, 8 and 9 will comprise a sensor 38 wired to a control unit 39, by which the individual notes 3 passing through the inlet 8 of the channel 6 are counted off. The notes having accumulated to a predetermined number, an output signal from the sensor 38 is relayed by the control unit 39 to the actuator 24, which thereupon advances the shutter 21 along the tracks 22 in the direction denoted F2 toward the position in which the mouth 8*a* at the inlet 8 of the channel 6 is occluded, in the same way as described previously with reference to the embodiment of FIGS. 2 to 6; accordingly, a single group 2 consisting in a given number of notes 3 is formed separately on the first shelf 18.

In operation, referring initially to FIG. 9*a*, the first shelf 18 is set in motion along the stacking axis 7 of the channel 6 during the formation of the group 2, passing from the raised position in which it occupies substantially the same plane as the mouth 8*a* at the inlet 8 of the channel 6 and begins receiving the notes 3, toward a lowered position at which it draws to a standstill in readiness for the gripper 47 to pick up the accumulated group 2 of notes.

One gripper head 53 only is illustrated in the schematic illustration of FIG. 9, given that the remaining head is identical and operates in similar fashion, performing the same steps as will now be described referring to the one head 53.

As the first shelf 18 draws into the lowered position, the gripper 47 assumes a first position in which it takes up and secures the group 2 of notes 3.

Having taken hold on the group 2, the gripper 47 moves toward a second position at which the group 2 will be transferred to the second strapping/banding station 52, as discernible in FIG. 9*a*, and released to the gripper heads 53 as indicated in FIG. 9*b*. During the step in which the group 2 is transferred to the second station 52, each gripper head 53 will be occupying the position indicated in FIG. 9*a*, with the first jaw 57 poised above and distanced from the second jaw 58 and the leading end 30*a* of the strip 30 held on the inner face 66 by the retaining means 68.

Once the group 2 has been taken up by the gripper heads 53 and located against the first arm 59, the control unit 39 will relay a signal to the rotary actuator 64, which proceeds to rotate the second shaft 62 through a first angular step around the common axis 54 (counterclockwise as seen in FIG. 9), with the result that the first jaw 57 rotates about the axis 54 through the same angular distance as the shaft 62 and is brought into contact with the face 70 of the group 2 of notes 3, occupying the position illustrated in FIG. 9*b*.

In this configuration, the leading end 30*a* of the strip 30 is held against the face 70 of the group 2 by the first jaw 57. The control unit 39 now relays a signal to the geared motor 61, which proceeds to rotate the first shaft 60 about the axis 54 through a first predetermined angle in the direction of the arrow denoted F7, with the result that the gripper heads 53 are taken through the successive positions illustrated in FIGS. 9*c* and 9*d*.

It will be observed that the position occupied by the heads 53 in FIG. 9*d* is the position illustrated in FIGS. 7 and 8.

The leading end 30*a* of the strip 30 stays pinned against the face 70 of the group 2 of notes 3 for the duration of the first angular step around the axis 54 of rotation, with the result that the strip is drawn along the feed path P and caused to wrap around the notes 3. More exactly, the strip 30 is pulled through the two freely revolving rollers 50 and decoiled from the roll 51. The decoiling action of the strip 30 is resisted by the rollers 50 and the roll 51, weakly, though sufficiently to ensure the strip 30 remains taut along the feed path P and wraps tightly around the group 2 of notes 3.

In the situation of FIG. 9*d*, the geared motors 61 receive a further signal from the control unit 39, and the heads 53 pause with the strip 30 tensioned and aligned beneath the outer face 67 of the first jaw 57.

Thereafter the second tool 71 is caused to rotate toward the group 2 of notes 3 through the agency of respective actuator means (not illustrated, being conventional in embodiment) in the direction of the arrow denoted F14 (counterclockwise as viewed in FIG. 9), and assume the position of FIG. 9*e*.

In the course of rotating toward the face 70 of the group 2 of notes 3, the second tool 71 combines with the first jaw 57 to cut through the strip 30, generating a discrete length and simultaneously sealing the leading end 30*a* and the trailing end of the selfsame cut length to fashion a band 40 around the group 2 and create a bundle 41.

At the same time, the newly cut leading end 30*a* of the strip 30 is taken up onto the outer face 67 of the first jaw 57 and the strip drawn taut along the feed path P.

Observing FIGS. 9*f*, 9*g* and 9*h* it will be seen that the second cutting and sealing tool 71 describes a trajectory consisting in three distinct components, of which the first is a rotation in the direction opposite to the first angular movement, indicated by the arrow denoted F15 in FIG. 9*f*, the second a linear movement in the direction indicated by the arrow denoted F12 in FIG. 9*g*, advancing toward the first jaw 57 until its outer face 67 enters into contact with and takes up the new leading end of the strip 30, and the third a linear movement in the direction denoted F13 in FIG. 9*h*, opposite to that of FIG. 9*g*, as a result of which the strip 30 is drawn through a predetermined short distance along the feed path P and tensioned.

On completion of the three movements, the control unit 39 activates the second gripper 47, whereupon the bundle 41 is taken up as indicated in FIG. 8 and transferred from the gripper heads 53 to the second shelf 42, then accompanied by the shelf along the stacking axis 7 of the formation channel 6 toward the relative outlet 9. Once the heads 53 have been vacated, the control unit 39 will pilot the rotary actuator 64 and the linear actuator 65 successively and synchronously to bring about the movement of the second shaft 62, and with it the first jaw 57, through a sequence of three distinct movements.

Observing FIGS. 8, 9*i* and 9*l*, the three movements in question consist in a first transverse movement along the first path S1, in the first direction F8, through a distance substantially equal to and not less than the width dimension of the strip 30, a second angular movement described around the common axis 54 of rotation in the direction denoted F11, away from the second jaw 58 and through an arc of length sufficient to clear the feed path P without touching the strip 30, to assume the position of FIG. 9*i*, and a third transverse movement along the second path S2 in the direction F9 opposite to the first direction F8 through a distance substantially equal to and not less than the width of the strip, ultimately gaining the position of FIG. 9*l* in which the inner face 66 of the first jaw 57 is able to engage the newly cut leading end of the strip 30.

Once this sequence of movements is completed, the second tool 71 rotates downward in the direction of the arrow denoted F15 and the geared motors 61 are piloted by the control unit 39 to generate a second angular step about the axis 54 of rotation, thereby completing one full revolution and returning the heads 53 to the position of FIG. 9*a* in readiness to take up the next group 2 of notes 3.

In like manner to the embodiment illustrated in FIGS. 2 to 6, the sequence of operations described referring to the device 1 illustrated in FIGS. 7, 8 and 9 will be repeated cyclically for each of the stacking modules 5 each time the relative sensor 38 confirms the accumulation of a predetermined number of single banknotes 3 making up one group 2.

Importantly, the facility of applying more than one band 40 to each group 2 of notes 3 is afforded by both of two the preferred embodiments disclosed, implementing the same sequence of operations as described above and illustrated in the accompanying drawings.

What is claimed is:

1. In a machine for processing notes, said machine having a feed duct and a plurality of stacking modules each equipped with a formation channel extending along a respective stacking axis, each formation channel having an inlet and outlet in communicating with the feed duct via a roller by which individual ones of the notes are taken up and transferred to the inlet of the relative formation channel, each formation channel having at least a first receiving element on which the notes are deposited one on top of another:

a device by which the notes advancing along the feed duct toward the outlet of the machine are formed into groups and strapped, said device comprising:

a pickup and strapper unit at the inlet of each formation channel, said pickup and strapper unit being structured and configured to cooperate with the first receiving element to form the notes into distinct groups along the stacking axis, each of the groups of notes being wrapped to produce a bundle, each said bundle being positioned for translation along the stacking axis of the formation channel.

2. A device as in claim 1, wherein the pickup and strapper unit comprises an element that occludes the inlet of the respective formation channel, said element operating in conjunction and synchronously with the roller so as to order and separate distinct groups on the first receiving element; a first strapper assembly equipped with a first feeder for advancing a strip of material transformable into at least one wrapping band along a predetermined feed path; a first strapping station at which a leading end of the strip is seized by a first gripping element capable of movement along a looped path so as to pass the strip around each of the groups of notes and thus fashion the at least one wrapping band; first means by which to pick up, transfer and release the group of notes, the first means being able to assume at least three successive positions identifiable respectively as a first pickup position in which a group of notes is taken up from the first receiving element, a second position in which the group of notes is transferred to the first strapping station and held stationary while the first gripping element holding the leading end of the strip completes the step of passing the strip around the group of notes to produce a bundle, and a third position in which the bundle is transferred and released to a second receiving element located along the formation channel at a point beyond the first feeder and serving to accompany each successive bundle along the stacking axis toward the outlet of the channel.

3. A device as in claim 2, wherein the first feeder comprises at least one pair of pinch rolls advancing the strip, a guide slidably supporting the strip, said guide comprising an anvil element for a cutting and sealing tool by which the strip is cut into discrete lengths and the leading end sealed to a trailing end of each cut length once the first gripping element has completed passing the strip around the group of notes to fashion the at least one wrapping band.

4. A device as in claim 2, wherein the first strapper station comprises a bracket that supports at least one specific portion of the group of notes, a presser arm operating synchronously and in conjunction both with the first means and the first gripping element, said presser arm being designed to compact at least the specific portion of the group of notes against the bracket.

5. A machine as in claim 1, wherein the pickup and strapper unit comprises an element that occludes the inlet of the respective formation channel, said element operating in conjunction and synchronously with the roller so as to order and separate distinct groups on the first receiving element; a second strapper assembly equipped with a second feeder that advances a strip of material transformable into at least one wrapping band along a predetermined feed path; second means by which to pick up and transfer the group of notes to a second strapper station equipped with a pair of mutually opposed gripper heads, pivotable about a common axis of rotation extending transversely to the stacking axis, said second strapper station occupying a substantially frontal position in relation to the inlet of the respective formation channel on each side of the stacking axis and designed to take up and retain two opposing extremities of a group of notes; and second means by which a leading end of the strip is picked up, retained, and pinned temporarily against one face of the group of notes; the gripper heads being disposed and embodied in such a way that each group of notes can be made to describe at least a first predetermined angular movement about an axis of rotation as one with the second means with the result that the strip is drawn along the feed path, wrapping tightly around the group of notes to fashion the at least one wrapping band and obtain a bundle.

6. A device as in claim 5, wherein the groups of notes are picked up, retained and transferred by second means able to assume at least four successive positions identifiable respectively as a first position in which the group of notes is taken up from the first receiving element, a second position in which the group of notes is transferred and released to the gripper heads and the second means are then separated, allowing the gripper heads to describe at least a first predetermined angular movement about the axis of rotation in such a way that a wrapping band is fashioned around the respective group of notes to produce a bundle, a third position in which the bundle is taken up from the heads, and a final position in which the bundle is released to a second receiving element located along the formation channel at a point beyond the first feed means and serving to accompany each successive bundle along the stacking axis toward the outlet of the channel.

7. A device as in claim 5, wherein each of the gripper heads is mounted to a relative support and drive unit such as will produce at least the first predetermined angular movement about the common axis of rotation.

8. A device as in claim 7, wherein each head comprises mutually opposed first and second jaws of which the first jaw, constituting second means by which to pick up and retain the leading end of the strip, presents an inner face directed toward the second jaw and an outer face on the side opposite from the inner face, both affording respective means designed to retain the leading end of the strip, and is capable of movement in relation to the second jaw at least between a first position distanced from the second jaw, in which the leading end of the strip is retained on the inner face in readiness for the approach of a group of notes, and a second position closer to the second jaw in which the group of notes is gripped by both jaws and the leading end of the strip held simultaneously in contact with one face of the group, the second of the two positions being maintained at least for as long as will allow each head to complete the first predetermined angular movement about the axis of rotation so that the strip is drawn forward and forced to wrap tightly around the group of notes.

9. A device as in claim 8, comprising a second cutting and sealing and retaining tool, operating in conjunction with the first jaw in such a way as to cut the continuous strip into discrete lengths and seal the leading end of the strip to the trailing end of each cut length.

10. A device as in claim 9, wherein the second tool is capable of movement between a first cutting and sealing position in which the strip is cut to produce a discrete length, the trailing end of the cut length is sealed to the leading end of the strip to fashion a wrapping band around the group of notes and the newly cut leading end of the strip is aligned with and retained by the outer face of the first jaw, and a second position of contact with the outer face of the first jaw in which the newly cut leading end of the strip is picked up from the same first jaw, drawn through a predetermined distance along a predetermined feed path and tensioned.

11. A device as in claim 8, wherein, with the first jaw and the second cutting and sealing tool both occupying their respective second positions and the bundle taken up by the second pickup and transfer means, the first jaw is able to assume at least three further operating positions identifiable respectively as a third position, in which the jaw is caused through the agency of first actuator means to effect a first offset movement transverse to the formation channel along a first predetermined path and in a first direction substantially transverse to the stacking axis, and distanced thus from the gripper head opposite to that with which it is associated sufficiently to clear the feed path followed by the strip, a fourth position in which the jaw is caused through the agency of second actuator means to describe a predetermined angular movement around the common axis of rotation of the heads, away from the second jaw and through an arc of length sufficient to clear the feed path without touching the strip, held currently and tensioned by the second tool, and a fifth position in which the jaw is caused to move along a second path parallel to the first in a second offset direction opposite to the first direction, through a distance substantially equal to the first, ultimately assuming a position in which the newly cut leading end of the strip can be taken up onto the inner face of the jaw destined to enter into contact with the face of the group of notes.

12. A device as in claim 8, wherein each gripper head is caused by the respective support and drive unit to describe a second predetermined angular movement about the common axis of rotation and to return thus from the position assumed following the first predetermined angular movement, in which the single bundle is taken up from the two heads by the second pickup and transfer means and the newly cut leading end of the strip retained on the inner face of the first jaw, toward the position of readiness to receive a successive group of notes.

13. A device as in claim 2, wherein the occluding element is capable of movement between a non-operating position in which the inlet of the formation channel remains open, allowing the notes to pass through unhindered and settle on the first receiving element, and an operating position in which the inlet of the channel remains blocked and the notes coming off the roller are intercepted, their passage to the first shelf interrupted in such a way as to make up and separate single distinct groups of the notes, by virtue of the occluding element affording a platform on which the notes are made to accumulate momentarily in predetermined number.

14. A device as in claim 13, wherein the first receiving element is capable of movement synchronously with the roller and the occluding element between a first raised position, occupied when the occluding element is in the non-operating position, lying adjacent to the inlet of the formation channel and able thus to receive the notes, and a lowered position coinciding with the first position assumed by the second pickup and transfer means when taking up the group of notes, and with the operating position of the occluding element.

15. A method of forming and strapping groups of notes advancing along a feed duct of a processing machine comprising a plurality of stacking modules each equipped with a formation channel presenting an inlet and an outlet and extending along a respective stacking axis; said method including: taking up single ones of said notes from the feed duct by means of a roller; transferring the notes to the inlet of the relative formation channel and depositing the notes one on top of another onto at least a first receiving element occupying the inlet of the channel; ordering and separating the notes into distinct groups at the inlet of each formation channel along the stacking axis; taking up each group of notes cyclically at the inlet of the channel by means of a pickup and strapper unit operating in conjunction with the first receiving element; applying at least one wrapping band to each group of notes to obtain bundles; and positioning each bundle along the stacking axis of the formation channel.

16. A method as in claim 15, wherein the applying at least one wrapping band to a relative group of notes is performed by a first strapper assembly constituting part of the pickup and strapper unit and involves: taking up the group of notes from the first receiving element and transferring the group to a first strapping station at which successive groups of notes are positioned and held stationary; causing a strip of material transformable into at least one wrapping band to advance toward the first strapping station having a strip feeder; taking up the leading end of the strip with a first gripping element and passing the strip around the group of notes so as to fashion the at least one band and create a bundle; picking up the bundle and transferring it to a second receiving element located along the formation channel at a point beyond the strip feeder; and accompanying the bundle along the stacking axis toward the outlet of the channel.

17. A method as in claim 16, wherein the applying the at least one wrapping band to a relative group of notes involves cutting the continuous strip into discrete lengths and, following passing the strip around the group of notes, securing the leading end of the strip to the trailing end of the cut length using a first cutting and sealing tool.

18. A method as in claim 15, wherein the applying at least one wrapping band to a relative group of notes is performed by a second strapper assembly constituting part of the pickup and strapper unit and involves: advancing a strip of material transformable into at least one wrapping band along a predetermined feed path; taking up the group of notes from the first receiving element and transferring the group to a second strapping station; taking up the leading end of the strip and positioning it stably in contact with one face of the group of notes, through the agency of second pickup and retaining means; causing the group of notes to effect at least a first predetermined angular movement about an axis of rotation extending transversely to the stacking axis of the respective formation channel while keeping the leading end of the strip pinned against the face of the group of notes; drawing the strip forward using a strip feeder during the first angular movement in such a way that it wraps tightly around the group of notes to fashion at least one band and create a bundle; picking up the bundle and transferring it to a second receiving element located along the formation channel at a point beyond the strip feeder; and accompanying the bundle along the stacking axis toward the outlet of the channel.

19. A method as in claim 18, further comprising taking up and retaining the single group of notes at two opposing extremities with a pair of mutually opposed gripper heads pivotable about a common axis of rotation extending substantially transverse to the stacking axis and equipped each with mutually opposed first and second jaws of which the first is capable of movement toward and away from the second jaw and presents an inner face directed toward the second jaw, and an outer face on the side remote from the inner face, each inner face and outer face furnished with respective means by which to retain the leading end of the strip; and taking up the leading end of the strip onto the inner face of the first jaw and pinning it against one face of the group of notes at least for a duration such as will allow each gripper head to complete the first predetermined angular movement about the axis of rotation.

20. A method as in claim 19, wherein the applying the at least one wrapping band to a relative group of notes involves cutting the continuous strip into discrete lengths and, following the first predetermined angular movement about the axis of rotation, securing the leading end of the strip to the trailing end of the cut length by means of a second cutting and sealing tool in such a way as to fashion a band around the group of notes.

21. A method as in claim and 18, 19, and 20, wherein the cutting and securing of the leading end of the strip to the trailing end of the cut length involves causing the newly cut leading end of the strip to be aligned with and retained by the outer face of the first jaw, taking up the newly cut leading end of the strip by means of the second cutting and sealing tool, and tensioning the strip from the selfsame newly cut end through a predetermined distance along the predetermined feed path.

22. A method as in claim 21, further shifting the first jaw a first time along a first predetermined path in a first direction substantially transverse to the stacking axis of the relative formation channel in order to separate it from the gripper head opposite to that with which it is associated by a distance sufficient to clear the feed path followed by the strip; separating the first jaw from the second jaw in such a way as to clear the feed path without the strip being touched; and shifting the first jaw a second time along a second path parallel to the first path in a second direction opposite to the first direction, through a predetermined distance substantially equal to the first, in such a way as to assume a position in which the newly cut leading end of the strip can be taken up onto the inner face destined to enter into contact with the face of the group of notes.

23. A method as in claim 18, further comprising causing each gripper head to describe a second predetermined angular movement about the common axis of rotation and return thus from the position assumed following the first predetermined angular movement, in which the single bundle is taken up from the two heads by the second pickup and transfer means and the newly cut leading end of the strip retained on the inner face of the first jaw, toward the position of readiness to receive a successive group of notes.

* * * * *